US007086360B1

(12) United States Patent
Schnell et al.

(10) Patent No.: US 7,086,360 B1
(45) Date of Patent: Aug. 8, 2006

(54) ASSEMBLY AND TORSIONAL STOP DEVICE FOR ROLLER TAPPETS OF A DRIVE IN AN INTERNAL COMBUSTION ENGINE

(75) Inventors: Oliver Schnell, Veitsbronn (DE); Christof Faria, Erlangen (DE); Peter Sailer, Erlangen (DE); Matthew Evans, Warren, MI (US)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/547,056

(22) PCT Filed: Jan. 16, 2004

(86) PCT No.: PCT/EP2004/000298

§ 371 (c)(1),
(2), (4) Date: Aug. 25, 2005

(87) PCT Pub. No.: WO2004/076822

PCT Pub. Date: Sep. 10, 2004

(51) Int. Cl.
*F01L 1/14* (2006.01)

(52) U.S. Cl. ..... 123/90.5; 123/90.48; 123/90.16

(58) Field of Classification Search ..... 123/90.15, 123/90.16, 90.27, 90.31, 90.48, 90.5, 198 F
See application file for complete search history.

(56) References Cited

U.S. PATENT DOCUMENTS

| | | | | |
|---|---|---|---|---|
| 5,088,455 | A | 2/1992 | Moretz | |
| 5,546,899 | A | 8/1996 | Sterling | |
| 5,678,514 | A | 10/1997 | Mazzella | |
| 6,257,189 | B1 | 7/2001 | Moretz et al. | |
| 6,405,699 | B1 | 6/2002 | Church | |
| 6,615,784 | B1 * | 9/2003 | Faria et al. | 123/90.5 |
| 6,745,737 | B1 * | 6/2004 | Evans et al. | 123/90.5 |

FOREIGN PATENT DOCUMENTS

| | | |
|---|---|---|
| DE | 101 10 914 A1 | 9/2002 |
| DE | 102 25 721 A1 | 1/2003 |
| DE | 101 42 329 A1 | 3/2003 |
| DE | 102 12 522 A1 | 10/2003 |

* cited by examiner

*Primary Examiner*—Thomas Denion
*Assistant Examiner*—Ching Chang
(74) *Attorney, Agent, or Firm*—Charles A. Muserlian

(57) ABSTRACT

The invention concerns a mounting and anti-rotation device (mounting aid) (1) for roller tappets of a valve train of an internal combustion engine in which gas exchange valves are activated by roller tappets. The roller tappets comprising a substantially cylindrical tappet body are retained in receptions (7, 8) of the mounting aid (1) that is made of plastic. With the help of opposing parallel anti-rotation surfaces that are arranged symmetrically to the longitudinal axis of the roller tappet and are disposed on the end of the tappet body that is oriented away from a roller, the roller tappets are guided secured against rotation in the mounting aid during the operation of the internal combustion engine. This is achieved by the fact that the inner profile of the receptions (7, 8) is matched to the outer profile of the roller tappets. To avoid mixing up the switchable with the non-switchable roller tappets during assembly, the distances between the anti-rotation surfaces on the different roller tappets, and thus also the inner contours of the corresponding receptions (7, 8) are chosen so as to differ markedly from each other. To achieve the correct orientation of the switchable roller tappets, for example, relative to an oil gallery, the anti-rotation surfaces of the switchable roller tappets and the corresponding receptions (8) of the mounting aid (1) are arranged asymmetrically to the longitudinal axis of the tappet body and comprise a groove (32) or a rib (35), respectively.

6 Claims, 4 Drawing Sheets

ASSEMBLY AND TORSIONAL STOP DEVICE FOR ROLLER TAPPETS OF A DRIVE IN AN INTERNAL COMBUSTION ENGINE

FIELD OF THE INVENTION

This application is a 371 of PCT EP2004/000298 filed Jan. 16, 2004.

The invention concerns a mounting and anti-rotation device (mounting aid) for roller tappets of a valve train of an internal combustion engine comprising at least two roller tappets comprising a substantially cylindrical tappet body and a roller mounted at one end to bear against an outer periphery of a cam of camshaft for being axially displaced by the cam, said tappet body comprising on an outer peripheral surface at an upper end oriented away from the roller, a dihedron formed by two preferably parallel flat surfaces, said mounting and anti-rotation device being adapted for attachment to an engine block and comprising receptions arranged behind one another for receiving the end of the outer peripheral surface of the roller tappets oriented away from the roller, an inner profile of the receptions being matched to an outer profile of the dihedron.

It is general knowledge in the field of internal combustion engines that the roller tappets of the valve train must be guided secured against rotation to prevent the roller from moving into a crosswise position relative to the direction of movement of the cam of the camshaft and thus prevent increased friction and the concomitant higher wear and fuel consumption. For this purpose, heat resistant plastic bridges are used, inter alia, in which the roller tappets are mounted secured against rotation through matching inner profiles of the receptions of the bridges and outer profiles of the roller tappets.

A generic mounting and anti-rotation device for roller tappets of a valve train of an internal combustion engine is known from U.S. Pat. No. 5,088,455 A. This device is made of heat resistant ceramics or glass fiber reinforced materials and is designed for attachment to the engine block and for receiving roller tappets individually in a plurality of receptions arranged behind one another. The roller tappets are inserted into and retained by these receptions, so that mounting is facilitated. A dihedron is arranged on the upper ends of the outer peripheral surface of the otherwise substantially cylindrical roller tappets. The receptions of the mounting aid have inner profiles matching this dihedron. The heights of the anti-rotation surfaces on the roller tappet and the mounting aid are configured such that the roller tappet can execute the full cam lift without completely leaving the mounting aid, so that the mounting aid prevents rotation of the roller tappet during operation by surface guidance.

Taking into account the requirement of reducing fuel consumption and pollutant emission, some of the cylinders of modern engines are designed for switching. For this purpose, a mechanism is required for actuating the gas exchange valves or keeping them in the closed position depending on the switching state in which they are. This can be achieved with the help of switchable roller tappets. Such switchable roller tappets comprise a first portion that actuates a gas exchange valve through a tappet pushrod and a rocker arm, and a second portion comprising a roller at a lower end that cooperates with a cam of a camshaft. The two portions are arranged concentrically in each other and can be connected to each other by a coupling device. In the deactivated state, the coupling device is released and the portion actuated by the cam can move freely relative to the other portion whereby the actuation of the gas exchange valve is interrupted. In the active state, the inner and the outer portions are connected firmly to each other through the coupling device and the movement of the cam effects an actuation of the gas exchange valve. The gas exchange valves of the non-switchable cylinders are driven by non-switchable roller tappets. A drawback of the prior art discussed above is that, during assembly, an erroneous association of switchable roller tappets to non-switchable cylinders and of non-switchable roller tappets to switchable cylinders is possible.

A further problem results from the fact that the coupling mechanism of the switchable roller tappet is hydraulically operated. For this purpose, a supply of hydraulic fluid to the coupling device has to be assured. This is realized through an oil gallery in the crankcase and an opening in the jacket of the roller tappet. Through this opening, the hydraulic fluid from the oil gallery is in direct communication with the coupling device and can thus act thereon. It is not guaranteed that, during assembly, the switchable roller tappets can be mounted only in that orientation in which the opening in the tappet jacket is aligned to the oil gallery.

OBJECTS OF THE INVENTION

It is an object of the invention to avoid the above drawbacks and thus provide a mounting and anti-rotation device in which the non-switchable roller tappets can be associated only to the cylinders that are not to be switched, the switchable roller tappets can be associated only to the cylinders that have to be switched, and in which, in addition, the switchable roller tappets can be mounted only in that orientation in which the opening in the outer jacket of the roller tappet is oriented toward the oil supply.

This and other objects and advantages of the invention will become obvious from the following detailed description.

SUMMARY OF THE INVENTION

The invention achieves the above objects by the fact that first and second roller tappets comprising dihedrons having different widths across flats are used, the dihedrons of one of the first roller tappets or second roller tappets being configured asymmetric to a longitudinal axis of respective said tappets and therefore possessing one long and one short anti-rotation surface, the mounting aid comprising first and second receptions that are configured so that the first roller tappets can only be inserted into the first receptions and the second roller tappets can only be inserted into the second receptions.

Due to the provision of different widths across flats of the dihedrons on the outer periphery of switchable and non-switchable roller tappets to which the inner contours of the respective receptions of the mounting aid are matched, it is assured that the roller tappets with the larger width across flats are not mounted in the receptions for the roller tappets with the smaller width across flats. Moreover, if roller tappets with the smaller width across flats are erroneously mounted in the receptions for the roller tappets with the larger width across flats, the mounting aid cannot hold them so that they fall out of the holding device during mounting on the engine block. Thus the error becomes apparent. Due to the asymmetric arrangement of the anti-rotation surfaces of the switchable roller tappets and the corresponding receptions of the mounting aid, it is guaranteed that switchable tappets can be fixed in the mounting aid only in the orientation in which the opening in the tappet jacket is aligned to the oil gallery in the cylinder head. A wrong assembly can thus be avoided in a simple and economic manner.

It is further proposed to arrange the fixing device of the mounting aid outside of the connecting line of the center points of the roller tappets, so that the mounting aid can be attached to the crankcase only in the correct orientation.

In another embodiment of the invention, a groove is arranged in the long anti-rotation surface of the dihedron on the outer portion of the switchable roller tappet, and a rib is arranged in the corresponding portion of the inner space of the mounting aid. This rib enters into positive engagement with the groove whose length is chosen so as to enable the execution of the cam lift. This is a further precautionary measure for assuring correct mounting orientation of the switchable roller tappet. The mounting aid being a cast or injected structure made of plastic, it is advantageous to provide the rib on the mounting aid and the groove on the outer jacket of the roller tappet because this can be done economically, for example, in a single stamping operation.

Alternatively, the groove may be arranged in the short anti-rotation surface of the dihedron on the outer portion of the switchable roller tappet and a rib for engaging this groove can be arranged at a corresponding point in the inner space of the reception of the mounting aid, the length of the groove being chosen so as to enable the execution of the cam lift. This is again a further precautionary measure for assuring correct mounting orientation of the switchable roller tappet and offers the same manufacturing advantages as mentioned above.

According to further propositions of the invention, every two adjacent receptions for roller tappets that activate gas exchange valves of the same cylinder have an identical inner contour, the mounting aid comprises a plurality of pairs of receptions with an identical inner contour, and the inner contour of each pair can be different from the inner contour of the other pairs. This results in an advantageous modular structure that enables a plurality of roller tappets of different designs to be mounted correctly and in a single work step.

BRIEF DESCRIPTION OF THE DRAWINGS

Further features and advantages of the invention will become obvious from the following description and the appended drawings in which an example of embodiment is illustrated in a simple form.

DETAILED DESCRIPTION OF THE DRAWINGS

Figure 2:
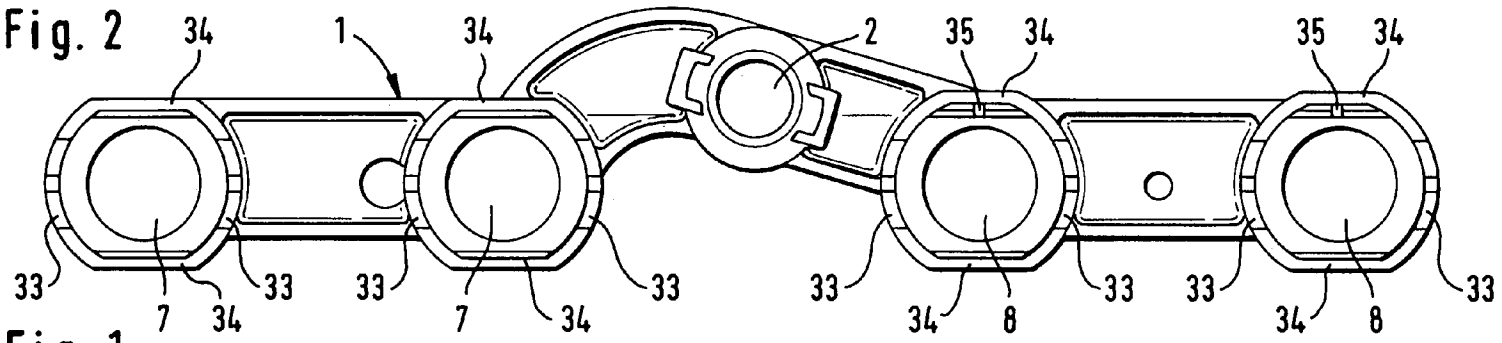
FIG. 2 is a top view of the mounting aid of FIG. 1.
Figure 1:
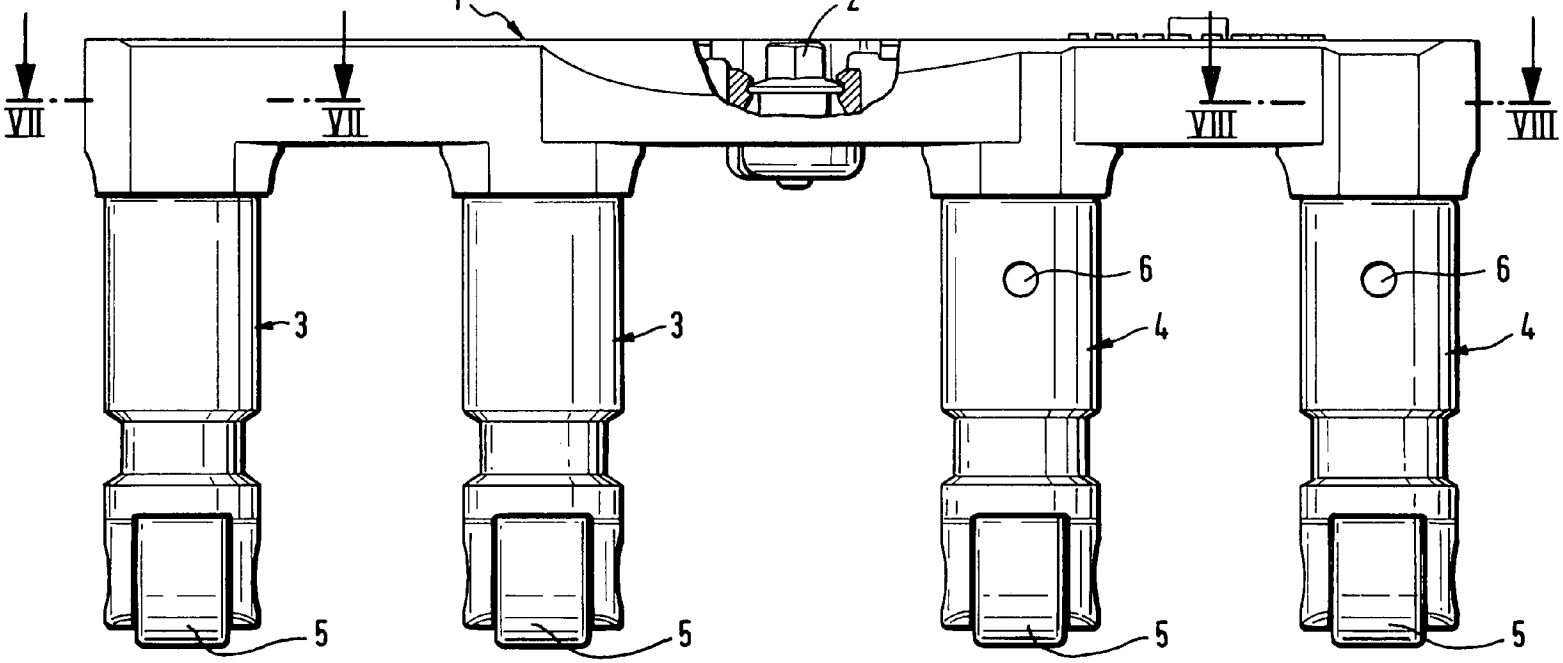
FIG. 1 is a side view of a mounting aid comprising switchable and non-switchable roller tappets, including a partial sectional view of the region of a fixing device.

FIG. 1 shows a mounting aid 1 of the invention comprising a fixing device 2 for fixing to a crankcase, not shown. The mounting aid 1 receives two non-switchable roller tappets 3 and two switchable roller tappets 4. Each roller tappet 3, 4 comprises a roller 5 and is mounted through a roller-distal end portion in the mounting aid 1. The roller tappets 4 that are switchable comprise, for this purpose, an opening 6 through which a pressure medium can be supplied. The roller tappets 3, 4 are inserted into reception openings 7, 8 (FIG. 2). Further, in the region of the fixing device 2, the mounting aid 1 has an asymmetric configuration with respect to its center point to prevent a wrongly oriented attachment of the mounting aid 1 to the crankcase.

Figure 3:
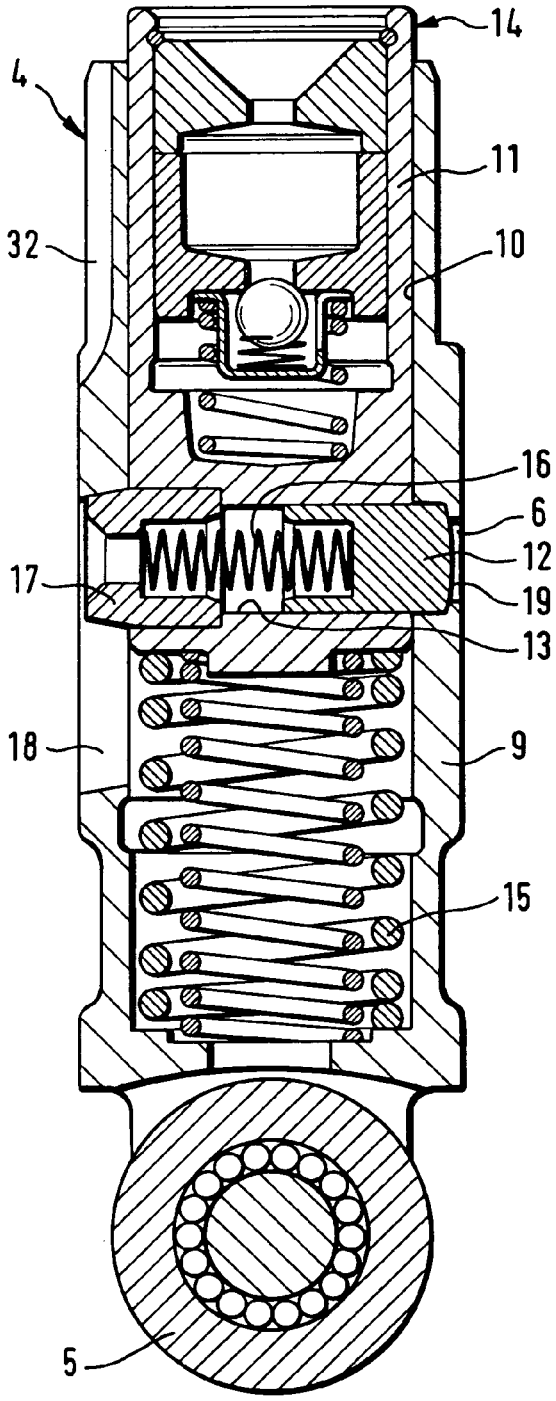
FIG. 3 shows a longitudinal section through a switchable roller tappet.
Figure 4:
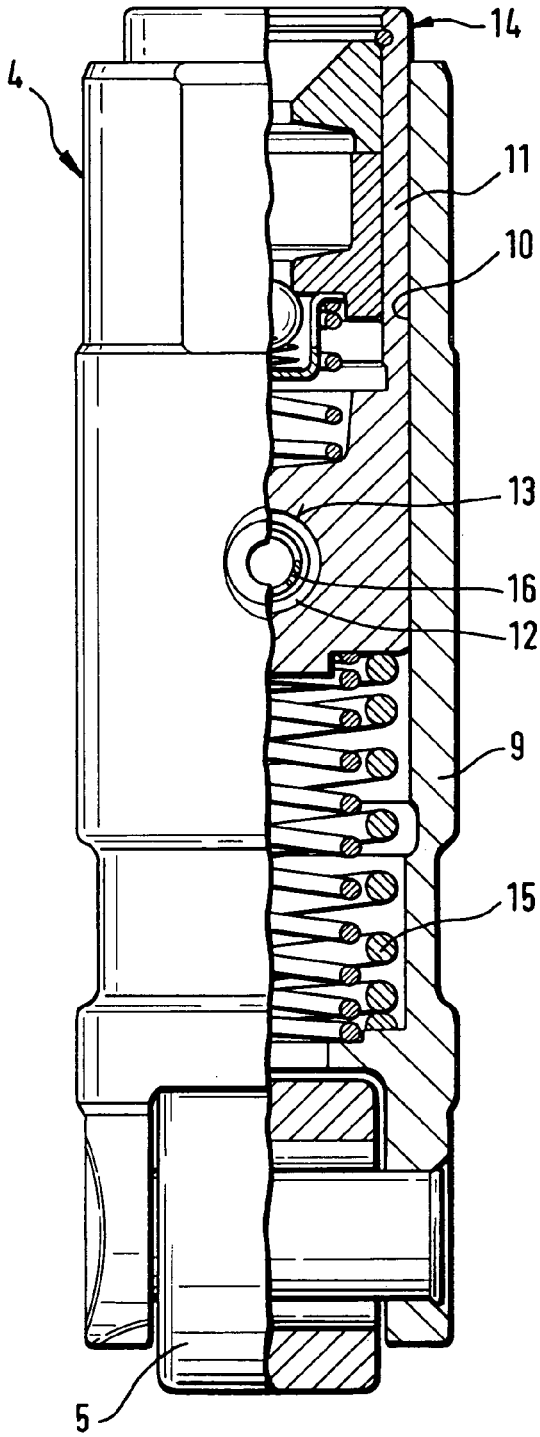
FIG. 4 shows a partial longitudinal section of the roller tappet of FIG. 3, offset at 90°.

A switchable roller tappet 4 is illustrated in FIGS. 3 and 4. This tappet substantially comprises an outer cylindrical portion 9 that receives a piston element 11 in its cylindrical reception 10. In addition, a coupling element 12 is arranged in a bore 13 in the lower end of the piston element 11. FIGS. 3 and 4 further show a valve lash adjuster 14 in the piston element 11 and a spring assembly 15 in the outer portion 9, said spring assembly serving to displace the piston element 11 into an end position. In the uncoupled state, the two components 9 and 11 are axially displaceable relative to each other. With the help of the coupling element 12, the outer portion 9 and the piston element 11 can be positively connected to each other. The coupling element 12 is displaced into the coupling position by a spring means 16 configured, in the present embodiment, as a coil spring. At its end oriented away from the coupling element 12, the spring means 16 is supported on an anti-rotation peg 17. This anti-rotation peg 17 is guided in a slot 18 of the cylindrical portion 9. The connection between the outer portion 9 and the piston element 11 can be released by applying a counter pressure to an end face 19 of the coupling element 12 through a hydraulic fluid.

Figure 5:
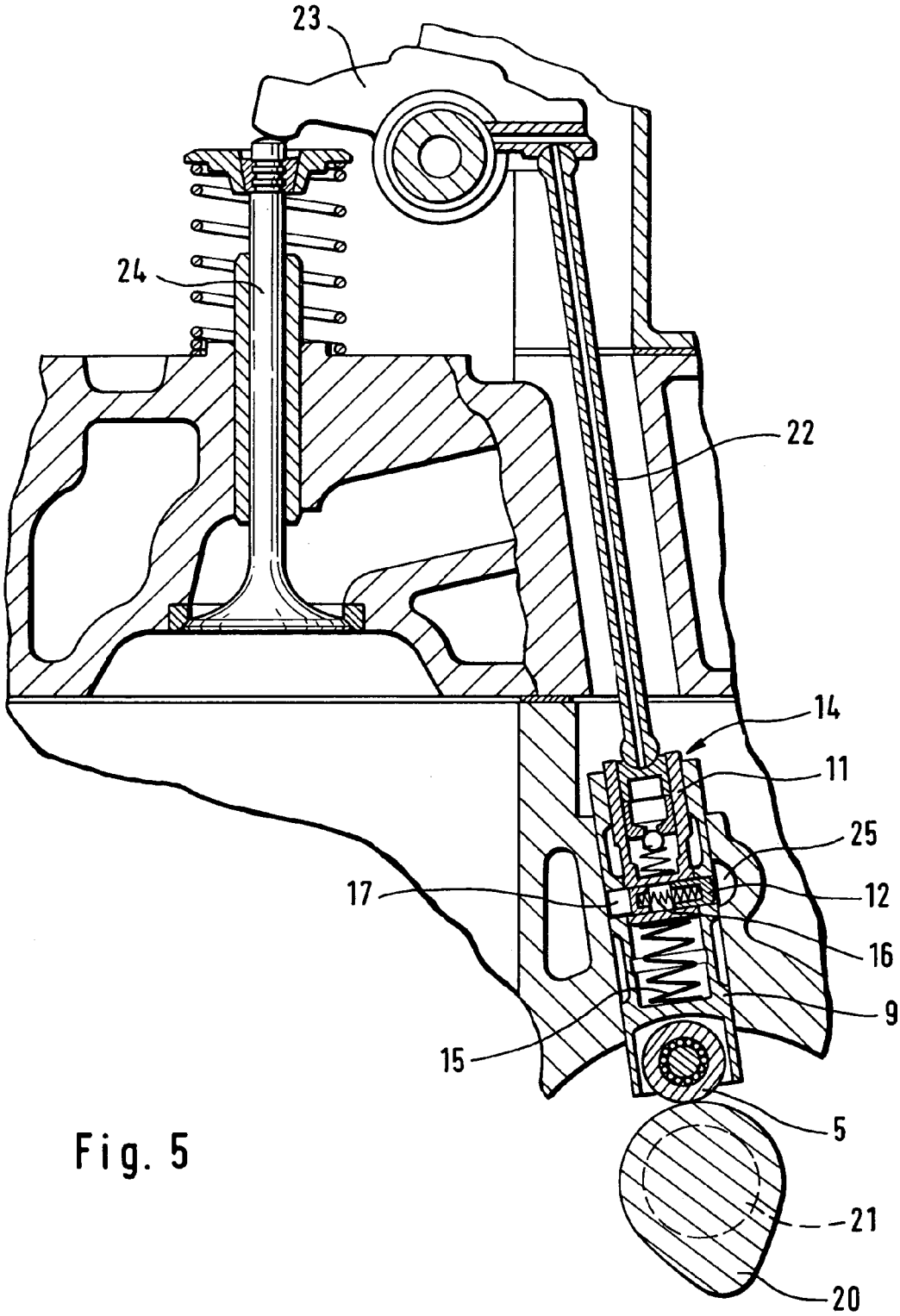
FIG. 5 shows a partial sectional view of an internal combustion engine comprising a switchable roller tappet.

FIG. 5 shows a longitudinal section through an internal combustion engine in which a switchable roller tappet 4 is axially displaced by a cam 20 of a camshaft 21. The longitudinal motion of the roller tappet 4 is transmitted through a tappet pushrod 22 and a rocker arm 23 to a gas exchange valve 24. To release the rigid connection between the outer portion 9 and the piston element 11, the counter pressure on the end face 19 of the coupling element 12 can be built up through an oil gallery 25 that communicates with the end face 19 through the opening 6 on the outer jacket of the switchable roller tappet 4. As a person skilled in the art will readily see from FIG. 5, the switchable roller tappet 4 can only perform its function if it is inserted in the correct orientation into its reception 8 to assure that the opening 6 of the outer cylindrical portion 9 is aligned to the oil gallery 25. This is achieved through the profiling of the outer cylindrical portion 9 of the switchable roller tappet 4 or the tappet body 26 of the non-switchable roller tappet 3 at the end of the roller tappets oriented away from the roller 5.

Figure 6A:
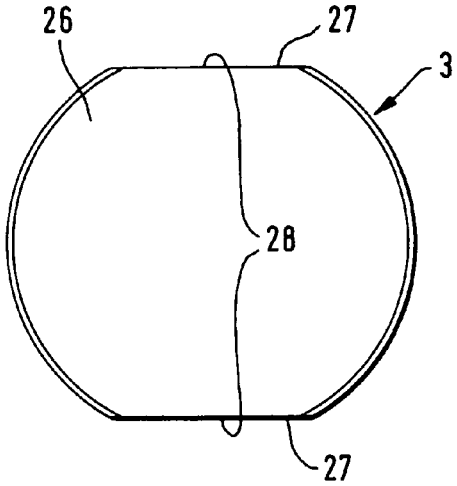
FIG. 6*a* is a top view of a non-switchable roller tappet.
Figure 6B:
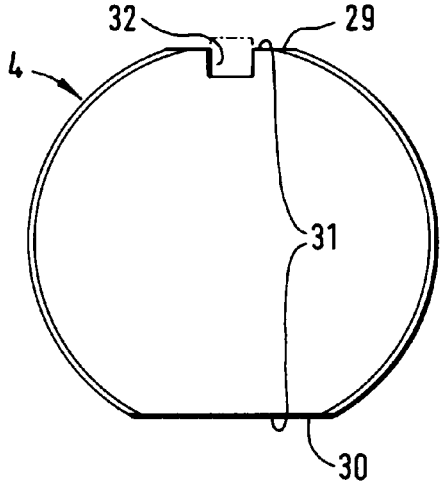
FIG. 6*b* is a top view of a switchable roller tappet.

FIG. 6*a* shows the end of the non-switchable roller tappet 3 oriented away from the roller 5 in a top view. The substantially cylindrical tappet body comprises two opposing, parallel anti-rotation surfaces 27 that form a dihedron 28. The dihedron 28 is arranged symmetrically to the tappet axis. As can be seen in FIG. 6*b*, the switchable roller tappet 4 also comprises two anti-rotation surfaces 29, 30 that form a dihedron 31. The width across flats of the dihedron 28 is markedly different from the width across flats of the dihedron 31. Moreover, the anti-rotation surfaces 29, 30 are arranged asymmetrically to the longitudinal axis of the roller tappet body and thus form a short anti-rotation surface 29 and a long anti-rotation surface 30. The short anti-rotation surface 29 comprises a groove 32.

The inner contours of the receptions 7, 8 of the non-switchable and switchable roller tappets 3, 4 comprise circular portions 33 and chord-like portions 34 and are matched to the outer contours of the respective roller tappets. In addition, the inner contour of each reception 8 for the switchable roller tappets 4 comprises a rib 35 that engages the groove 32 of the short anti-rotation surface 29 of the switchable roller tappet 4.

Figure 7:
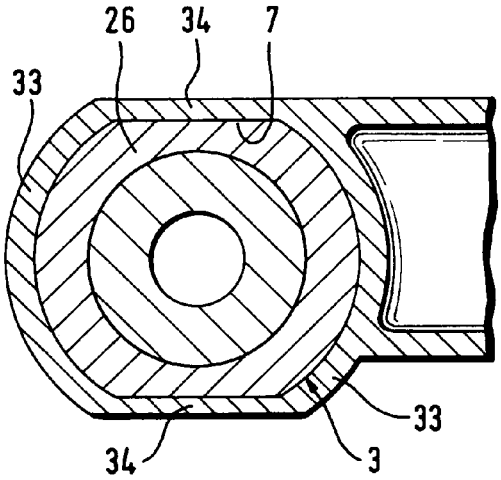
FIG. 7 shows a cross-section along line VII—VII of FIG. 1 through the mounting aid having an inserted, non-switchable roller tappet.
Figure 8:
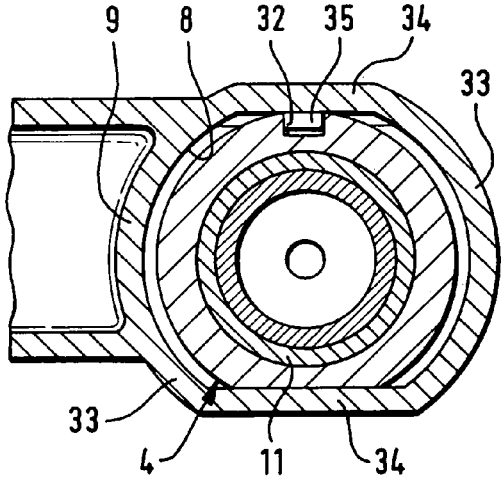
FIG. 8 shows a cross-section along ling VIII—VIII of FIG. 1 through the mounting aid having an inserted, switchable roller tappet.

The roller tappets are inserted into and held in the receptions 7, 8 through their ends oriented away from the roller 5. As disclosed in FIGS. 7, 8, the anti-rotation surfaces 27, 29, 30 of the roller tappets 3, 4 assure, in cooperation with the chord-like portions 34 of the receptions 7, 8 of the mounting aid 1, that the roller tappets 3, 4 are guided secured against rotation during the operation of the internal combustion engine. These structures further assure that the switchable roller tappets 4 are not inserted into the receptions 7 for the non-switchable roller tappets 3, and vice versa. As a person skilled in the art will readily see from FIGS. 7, 8, these contours also prevent the switchable roller tappets 4 comprising the dihedron 31 with the larger width across flats from being erroneously inserted into the receptions 7 that are intended for the non-switchable roller tappets 3 comprising the dihedron 28 with the smaller width across flats. On the other hand, a non-switchable roller tappet 3 having the smaller dihedron width across flats, if erroneously inserted into a reception 8 of the switchable roller tappet 4 having the larger dihedron width across flats, would fall out when the mounting aid 1 is fixed to the crankcase, so that the error will become apparent. The eccentrically arranged anti-rotation surfaces 29, 30 of the switchable roller tappet 4, as also the groove 32 in the shorter anti-rotation surface 29 in cooperation with the rib 35 of the reception 8 of the mounting aid 1, guarantee that the switchable roller tappet 4 can only be inserted in the correct orientation.

The invention claimed is:

1. A mounting and anti-rotation device for roller tappets of a valve train of an internal combustion engine comprising at least two roller tappets comprising a substantially cylindrical tappet body and a roller mounted at one end to bear against an outer periphery of a cam of camshaft for being axially displaced by the cam, said tappet body comprising on an outer peripheral surface at an upper end oriented away from the roller, a dihedron formed by two parallel flat surfaces, said mounting and anti-rotation device (mounting aid) being adapted for attachment to an engine block and comprising receptions arranged behind one another for receiving the end of the outer peripheral surface of the roller tappets oriented away from the roller, an inner profile of the receptions being matched to an outer profile of the dihedron, wherein first and second roller tappets comprising dihedrons having different widths across flats are used, the dihedrons of one of the first roller tappets or second roller tappets being configured asymmetric to a longitudinal axis of respective said tappets and therefore possessing one long and one short flat surface constituting a long and a short anti-rotation surfaces, the mounting aid comprising first and second receptions that are configured so that the first roller tappets can only be inserted into the first receptions and the second roller tappets can only be inserted into the second receptions.

2. A valve train of claim 1, wherein a fixing device of the mounting aid is arranged outside of a connecting line of center points of the roller tappets.

3. A valve train of claim 1, wherein one of the short and the long anti-rotation surfaces of the dihedron configured asymmetric to the tappet axis comprises a groove and a corresponding one of the receptions comprises a matching rib, a length of the groove corresponding at least to a cam lift.

4. A valve train of claim 3, wherein one of the rib and the groove is arranged in the short anti-rotation surface of the mounting aid.

5. A valve train of claim 1, wherein every two adjacent receptions of the mounting aid form a unit and have identical inner profiles.

6. A valve train of claim 5, wherein the mounting aid comprises at least two units.

* * * * *